US006761622B2

(12) United States Patent
Nam

(10) Patent No.: US 6,761,622 B2
(45) Date of Patent: Jul. 13, 2004

(54) BOWLING BALL RESURFACING DEVICE

(75) Inventor: Yun Sung Nam, 3523 Capilano Rd., North Vancouver B.C. (CA), V7R 4H9

(73) Assignee: Yun Sung Nam, North Vancouver (CA)

( * ) Notice: Subject to any disclaimer, the term of this patent is extended or adjusted under 35 U.S.C. 154(b) by 29 days.

(21) Appl. No.: 10/224,627

(22) Filed: Aug. 21, 2002

(65) Prior Publication Data

US 2003/0049996 A1 Mar. 13, 2003

(30) Foreign Application Priority Data

Aug. 21, 2001 (KR) ..... 2001-50248
Jul. 29, 2002 (KR) ..... 2002-44679

(51) Int. Cl.[7] ..... B24B 11/02

(52) U.S. Cl. ..... 451/178; 451/451; 451/50; 451/268

(58) Field of Search ..... 451/178, 50, 112, 451/450, 548, 262, 268

(56) References Cited

U.S. PATENT DOCUMENTS 3,714,703 A * 2/1973 Maples ..... 29/560
5,299,394 A * 4/1994 Surdacki ..... 451/50
5,613,896 A * 3/1997 Haus et al. ..... 451/50
6,186,875 B1 * 2/2001 Cook et al. ..... 451/268
6,439,982 B1 * 8/2002 Klukos ..... 451/307

* cited by examiner

*Primary Examiner*—Lee D. Wilson
(74) *Attorney, Agent, or Firm*—Lowe Hauptman Gilman & Berner LLP

(57) ABSTRACT

A bowling ball resurfacing device is capable of evenly abrading, machining and furbishing the entire surface of a bowling ball. The resurfacing device includes a housing, first and second rolling wheels which are rotatably provided within the housing in a spaced-apart relationship with each other to hold and support the bottom surface of the bowling ball, a driving motor operatively connected to the first and second rolling wheels for causing the first and second rolling wheels to rotate, a friction contact unit for supporting the bowling ball in cooperation with the first and second rolling wheels and for making frictional contact with the surface of the bowling ball to abrade the bowling ball, and a relative speed regulator for intermittently changing the rotational speed of the second rolling wheel with respect to the first rolling wheel so as to alter the axis of rotation of the bowling ball.

20 Claims, 5 Drawing Sheets

BOWLING BALL RESURFACING DEVICE

BACKGROUND OF THE INVENTION

1. Field of the Invention

The present invention relates to a device for abrading, machining, polishing and washing a spherical object such as a bowling ball, and more particularly, to a bowling ball resurfacing device capable of uniformly resurfacing the entire surface of a bowling ball while causing the bowling ball to rotate in various directions.

2. Description of the Prior Art

Since a bowling ball rolls on a lane with friction against the lane, a surface of the ball is susceptible to wear or scratch, In particular, since the bowling ball always comes into contact with the lane at their substantially identical contact portions, only a specific portion of the bowling ball may be unevenly worn. The unevenly worn or scratched bowling ball makes it difficult for a bowler to freely use his/her skills due to its unpredictable and irregular spin. Consequently, the unevenly worn or scratched bowling ball reduces the joy in the game and exerts a great adverse influence on the score of the game. Therefore, in order to remove the scratch from the ball and to make a perfect sphere of the ball, the surface of the bowling ball should be periodically resurfaced.

In consideration of the above, there have been proposed a plurality of automatic bowling ball resurfacing machines. By way of example, U.S. Pat. No. 5,613,896 discloses a bowling ball resurfacing machine comprising three shafts each pivotally disposed in a main body at an angular interval of 120 degrees around a bowling ball in a manner as to support the bowling ball therein, driving motors for rotating the corresponding shafts in a forward/reverse direction, and abrasive cloths attached to the shafts for resurfacing the bowling ball.

The bowling resurfacing machine of the '896 patent has an advantage in that it can efficiently resurface the bowling ball, but still has a disadvantage in that the bowling ball is unevenly resurfaced because its rotating direction cannot be vigorously changed during the resurfacing process. Further, there is another disadvantage in that high capacity driving motors for rotating the shafts in the forward/reverse direction during the resurfacing process are required. Furthermore, there are problems in that noise is generated from the driving motors of which forward/reverse rotation is repeated and life of the driving motors is shortened due to frequently repeated forward/reverse rotation of the motors.

As another example, there has been proposed a bowling ball resurfacing device in Korean Patent Laid-Open Publication No. 2002-39093. The Korean publication discloses a bowling ball resurfacing device capable of abrading and machining a surface of a bowling ball while causing the ball to rotate in various directions. The resurfacing device attempts to solve the drawbacks inherent in the aforementioned bowling ball resurfacing device and comprises a plurality of supporting posts rotatable about corresponding vertical axes; a plurality of rollers which are rotatable about corresponding horizontal axes and mounted on a top end of each of the supporting posts to support a lower portion of the bowling ball; a first driving mechanism for causing each of the rollers to revolve on the corresponding horizontal axis; a second driving mechanism for causing each of the posts to revolve on the corresponding vertical axis so that the rollers can be rotated; and an abrasive member for coming into friction contact with the surface of the bowling ball and resurfacing the bowling ball. According to this bowling ball resurfacing device, the first driving mechanism and the rollers cause the bowling ball to revolve on the horizontal axis, and then, the second driving mechanism and the supporting posts cause the rollers to be inclined at a predetermined angle with respect to the corresponding vertical axes. Thus, the surface of the bowling ball held and supported on the rollers can be abraded and furbished while changing an axis of rotation thereof in many different directions.

However, the bowling resurfacing device has an advantage in that the surface of the bowling ball can be evenly abraded and furbished while causing the bowling ball to rotate in the different directions, but still has a disadvantage in that since the structure thereof is complex, it is difficult to manufacture the resurfacing device, production costs thereof are increased, and failure thereof occurs frequently.

SUMMARY OF THE INVENTION

Accordingly, the present invention is contemplated to solve the above and other problems inherent in the prior arts. An object of the present invention is to provide a spherical object resurfacing device capable of uniformly abrading, machining, polishing and washing the entire surface of a spherical object without leaving any unevenly worn area on the bowling ball surface.

Another object of the present invention is to provide a bowling ball resurfacing device that has a simplified structure and can be manufactured in a cost-effective manner, while exhibiting an enhanced durability and operability.

In order to achieve the above objects of the present invention, there is provided a bowling ball resurfacing device comprising a housing, first and second rolling wheels which are rotatably provided within the housing in a spaced-apart relationship with each other to hold and support the bottom surface of the bowling ball, a driving motor operatively connected to the first and second rolling wheels for causing the first and second rolling wheels to rotate, a friction contact unit for supporting the bowling ball in cooperation with the first and second rolling wheels and for making frictional contact with the surface of the bowling ball to abrade the bowling ball, and a relative speed regulator for intermittently changing the rotational speed of the second rolling wheel with respect to the first rolling wheel so as to alter the axis of rotation of the bowling ball.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION FOR PREFERRED EMBODIMENT

A preferred embodiment of a bowling ball resurfacing device according to the present invention will now be explained in detail with reference to the accompanying drawings.

Figure 1:
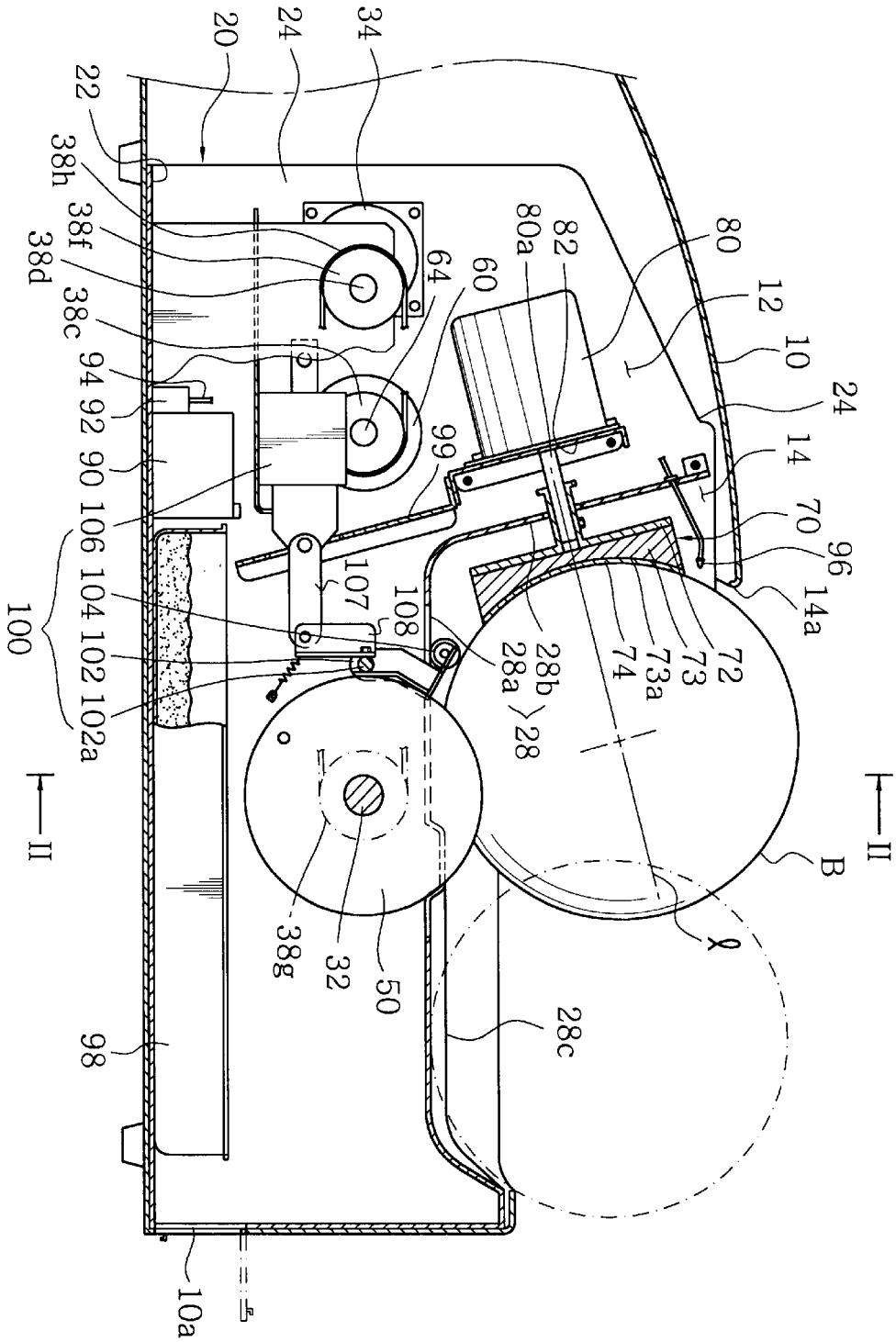
FIG. 1 is a side sectional view showing the constitution of a bowling ball resurfacing device according to the present invention.

Referring first to FIG. 1, the bowling ball resurfacing device according to the present invention includes a housing 10 which includes a driving chamber 12 and an abrading chamber 14. The abrading chamber 14 is provided at its one side with an access opening 14*a* through which a bowling ball B can be introduced into the abrading chamber 14. Further, as shown in FIG. 2, a series of push buttons 16 and a timer 17 are arranged onto the outer surface of the housing 10, whereas a control board 19 is mounted onto the inner surface of the housing 10.

A frame 20 is also provided within the housing 10. The frame 20 comprises a base 22, a pair of first and second vertical plates 24, 26 mounted at opposite sides of the base 22 to face each other, and a partition 28 for dividing the interior of the housing 10 into the driving chamber 12 and the abrading chamber 14 as shown in FIG. 1. Specifically, the partition 28 is composed of a vertical portion 28*b* and a horizontal portion 28*a* for supporting the bowling ball B introduced into the abrading chamber.

Figure 2:
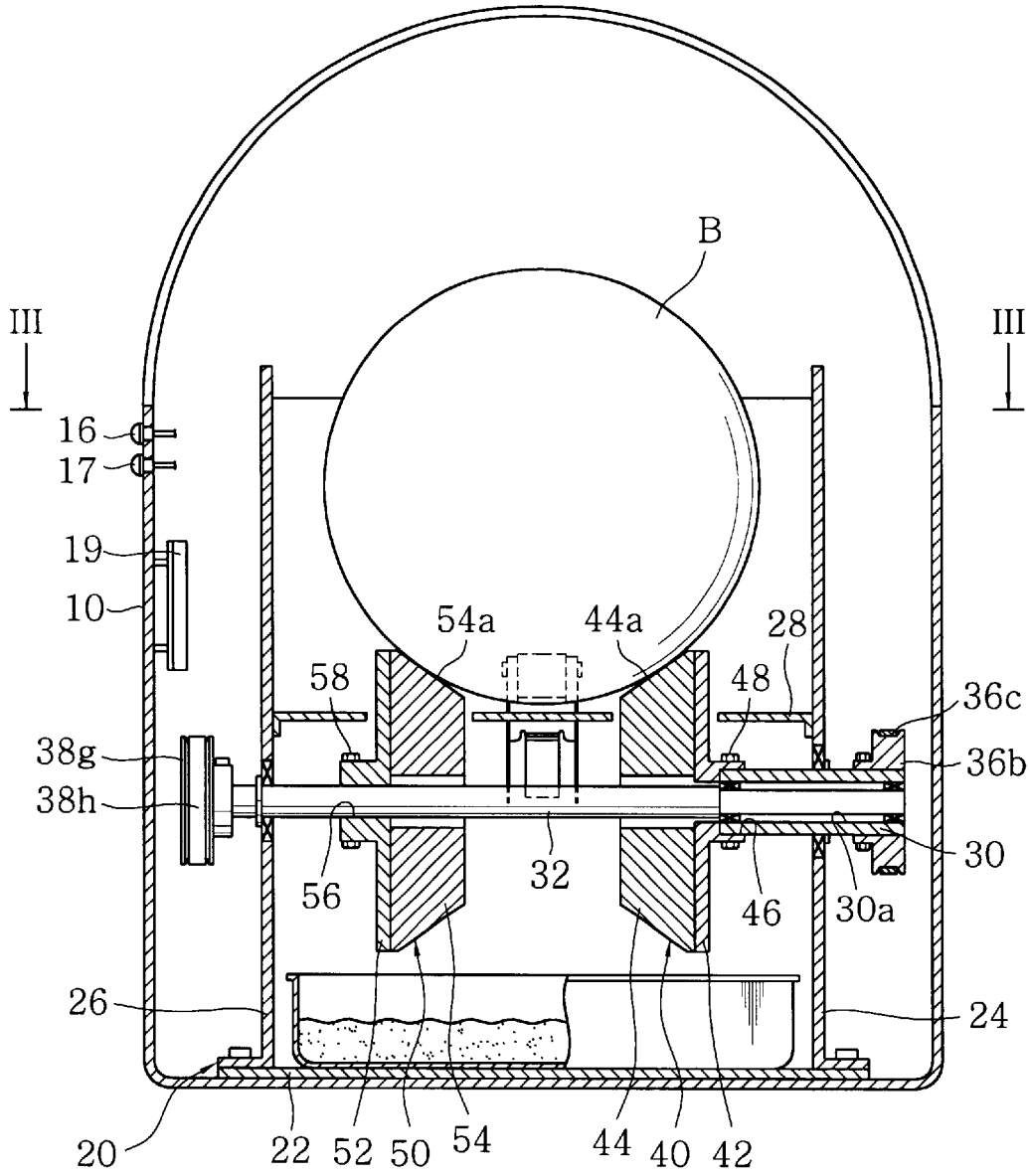
FIG. 2 is a sectional view taken along line II—II of FIG. 1.

In the meantime, as shown in FIG. 2, first and second driving shafts 30, 32 are rotatably installed at the first and second vertical plates 24, 26 of the frame 20, respectively. The first driving shaft 30 is a hollow shaft rotatably supported by the first vertical plate 24. The second driving shaft 32 is constructed such that one side thereof is rotatably supported by the second vertical plate 26. Further, the other side of the second driving shaft 32 is supported by the first driving shaft 30 in such a manner that it extends horizontally to and is fitted into a bore 30*a* of the first driving shaft 30 so that it can be freely rotated within the first driving shaft 30.

The first and second driving shafts 30, 32, which are rotatably mounted to the first and second vertical plates 24, 26, respectively, can be independently rotated with respect to each other. In particular, since the second driving shaft 32 is rotatably fitted into the bore 30*a* of the first driving shaft 30, the first and second driving shafts 30, 32 can be rotated independently but about the same axis of rotation.

Figure 3:
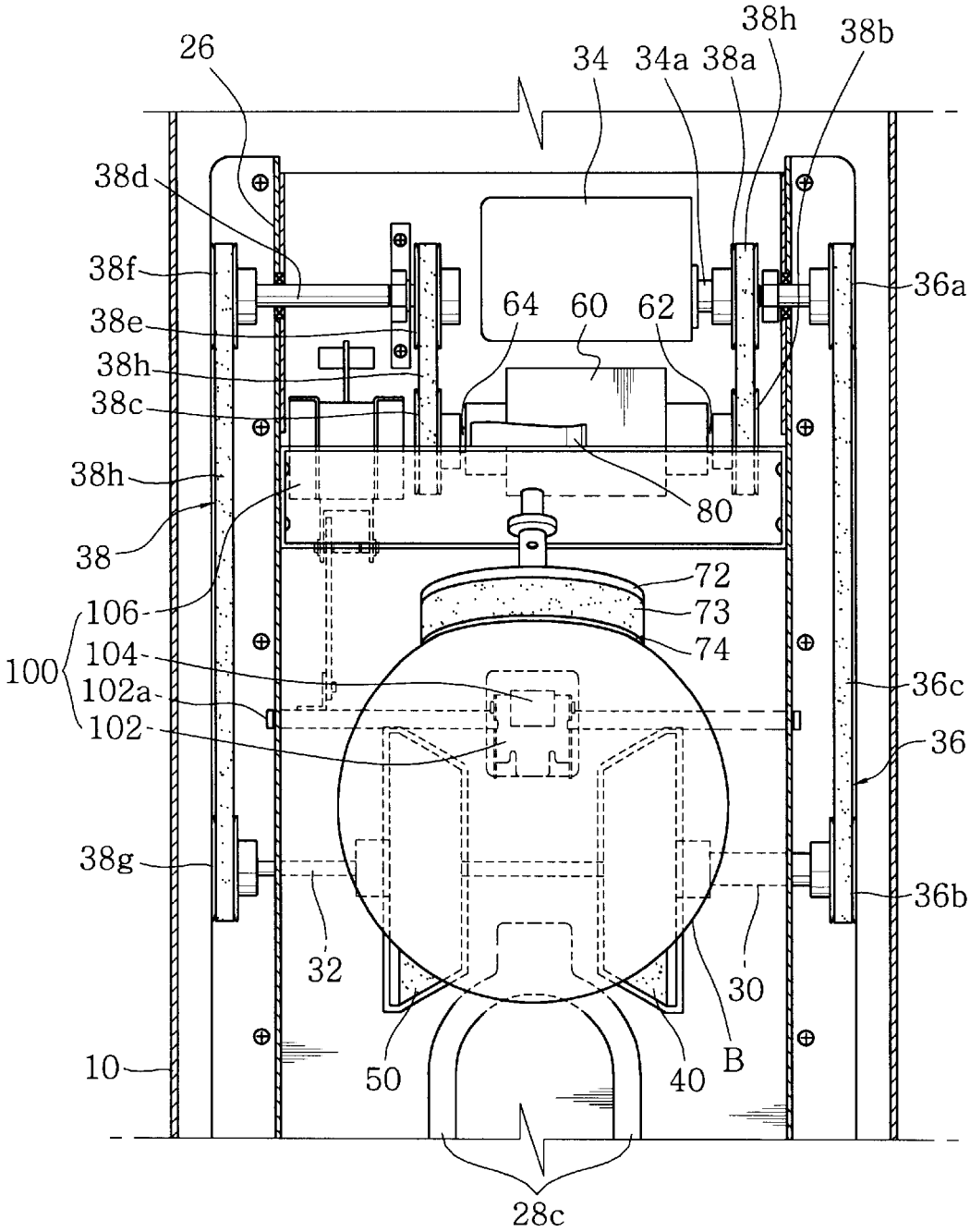
FIG. 3 is a sectional view taken along line III—III of FIG. 2.

As shown in FIG. 3, the first and second driving shafts 30, 32 are operatively connected with the first driving motor 34, and thus, they can be individually rotated with power transmitted from the first driving motor 34. Here, the first driving shaft 30 is connected with the first driving motor 34 through a first power transmitting mechanism 36. The first power transmitting mechanism 36 includes a driving pulley 36*a* mounted to a shaft 34*a* of the first driving motor 34, a driven pulley 36*b* mounted to the first driving shaft 30, and a belt 36*c* which is wrapped around and connects the driving and driven pulleys 36*a*, 36*b*.

Further, the second driving shaft 32 is connected with the first driving motor 34 through a second power transmitting mechanism 38. The second power transmitting mechanism 38 includes a driving pulley 38*a* mounted to the shaft 34*a* of the first driving motor 34; first and second intermediate pulleys 38*b*, 38*c* mounted to input and output shafts 62, 64 of the a clutchbrake unit 60 to be described later, respectively; an intermediate shaft 38*d* rotatably mounted to the second vertical plate 26; third and fourth intermediate pulleys 38*e*, 38*f* mounted to opposite ends of the intermediate shaft 38*d*; a driven pulley 38*g* mounted to the second driving shaft 32; and a plurality of belts 38*h* which are wrapped around and connect the driving and first intermediate pulleys 38*a*, 38*b*, the second and third intermediate pulleys 38*c*, 38*e*, and the fourth and driven pulleys 38*f*, 38*g*, respectively.

It is preferred that these first and second power transmitting mechanisms 36, 38 be constructed to transmit the power of the first driving motor 34 to the first and second driving shafts 30, 32 in the same direction and speed of rotation as each other. Thus, the first and second driving shafts 30, 32 are rotated at the same direction and speed of rotation as each other.

Referring again to FIG. 2, the first and second driving shafts 30, 32 are mounted with first and second rolling wheels 40, 50, respectively. The first rolling wheel 40 includes a wheel disk 42 and an annular wheel pad 44 fixed to the wheel disk 42, and is constructed such that an upper portion thereof protrudes upward beyond the partition 28. The wheel disk 42 is provided with a coupling hole 46 into which the first driving shaft 30 is fitted. The wheel disk 42 is fixed to the first driving shaft 30 by means of a fastening bolt 48 and is consequently rotated together with the first driving shaft 30. Furthermore, the wheel pad 44 supports and holds the bowling ball B and is provided with an inclined surface 44*a*. The inclined surface 44*a* is formed by causing a diameter of the wheel pad to be reduced toward a distal end thereof, and is used to directly support and hold the bowling ball B at a portion of a bottom surface thereof. Here, the wheel pad 44 is made of rubber or polyurethane material so that the bowling ball B cannot be damaged and a high friction coefficient can be maintained between the ball and the pad. Moreover, the wheel pad 44 is constructed such that it can be separated from the wheel disk 42, if necessary. Thus, the wheel pad can be exchanged when it has been worn or damaged.

The second rolling wheel 50 is disposed to face the first rolling wheel 40 at a predetermined interval. The second rolling wheel 50 includes a wheel disk 52 and an annular wheel pad 54 fixed to the wheel disk 52, and is constructed such that an upper portion thereof protrudes upward beyond the partition 28. The wheel disk 52 is provided with a coupling hole 56 into which the second driving shaft 32 is fitted. The wheel disk 52 is fixed to the second driving shaft 32 by means of a fastening bolt 58 and is consequently rotated together with the second driving shaft 32. Furthermore, the wheel pad 54 supports and holds the bowling ball B and is provided with an inclined surface 54*a* in the same manner as the wheel pad 44 of the first rolling wheel 40. In particular, the inclined surface 54*a* forms a rough "V" shape in combination with the inclined surface 44*a* of the first rolling wheel 40 so that they can support and hold the bowling ball B at both symmetric portions of the bottom surface thereof. The wheel pad 54 is also made of rubber or polyurethane material in the same manner as the wheel pad 44 of the first rolling wheel 40. Moreover, the wheel pad 54 is constructed such that it can be separated from the wheel disk 52.

The first and second rolling wheels 40, 50 constructed as such support the bowling ball B at the two symmetrical portions of the bottom surface thereof in a state where they are coupled with the first and second driving shafts 30, 40, respectively. Further, while the two rolling wheels 40, 50 are rotated together with the first and second driving shafts 30, 32, they exert any force on the two symmetrical portions of the bottom surface of the bowling ball B so as to cause the bowling ball to rotate.

In the meantime, the second rolling wheel of the present invention is constructed such that its relative rotational speed with respect to the first rolling wheel 40 can be intermittently changed. To this end, as a relative speed regulator for changing the rotational speed of the second rolling wheel 50 according to the present invention, there is provided the clutch-brake unit 60 for intermittently interrupting power of the first motor 34, which is transmitted to the second rolling wheel 50, as shown in FIG. 3. The clutch-brake unit 60 functions as both a clutch and a brake, and includes an input shaft 62 connected to the first driving motor 34 and an output shaft 64 connected to the intermediate shaft 38d of the second power transmitting mechanism 38. The clutch-brake unit 60 itself is well known in the art, and it is, for example, manufactured and sold under a tradename "HCB-OO-12" by Hyojoongijeon Co., Ltd. located at Kyungki-do, Republic of Korea. One may contact Hyojoongijeon Co., Ltd. at a telephone number: 82-2-684-3330, a facsimile number: 82-2-684-3338, an e-mail address: jaeflira@hanmail.net, and can visit its Internet homepage: http://www.clutch21.co.kr.

The clutch-brake unit 60 can intermittently interrupt a rotational force of the first driving motor 34, which is transmitted to the output shaft 64 through the input shaft 62, and can also quickly brake the disconnected output shaft 64. The reason that the power of the first driving motor 34 transmitted to the second rolling wheel 50 is intermittently interrupted is that the 30 rotational speed of the second rolling wheel 50 with respect to the first rolling wheel 40 can be caused to be periodically changed so as to change an axis of rotation of the bowling ball B.

Figure 4A:
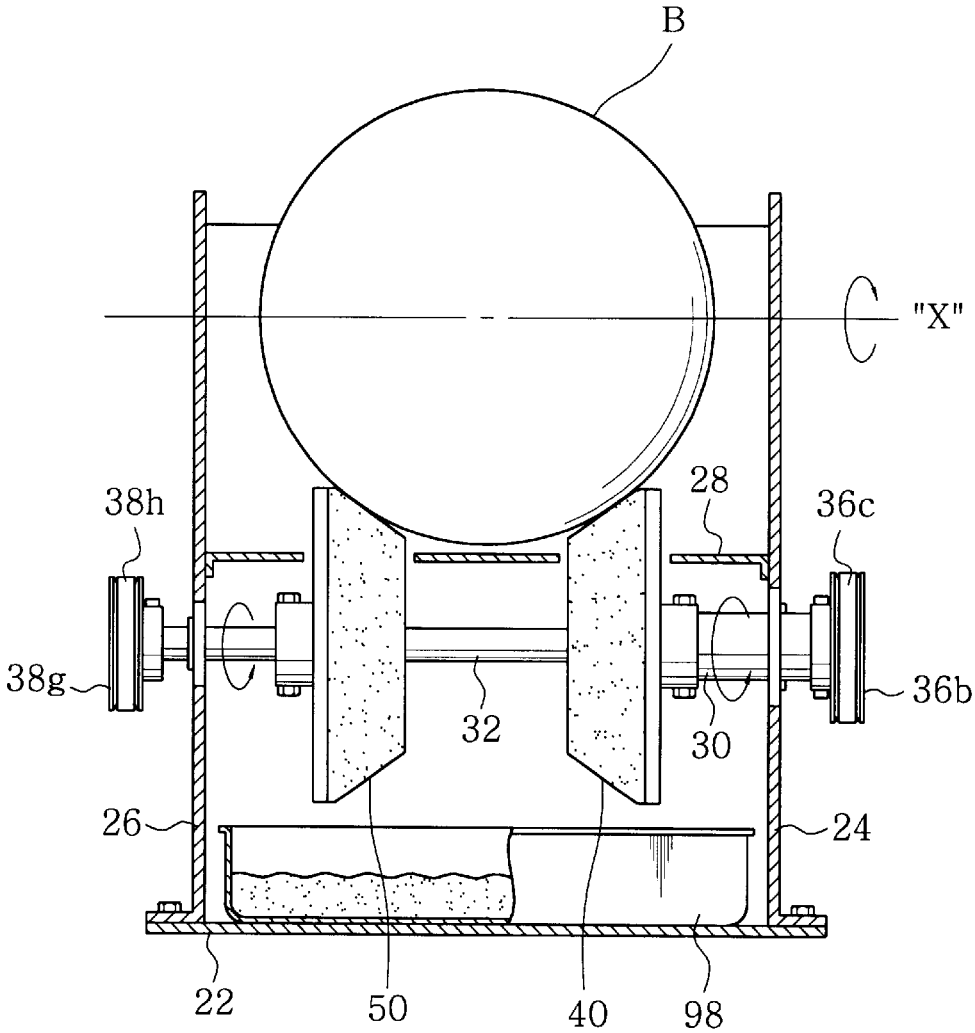
FIGS. 4*a* and 4*b* are views illustrating the operation of the resurfacing device according to the present invention.
Figure 4B:
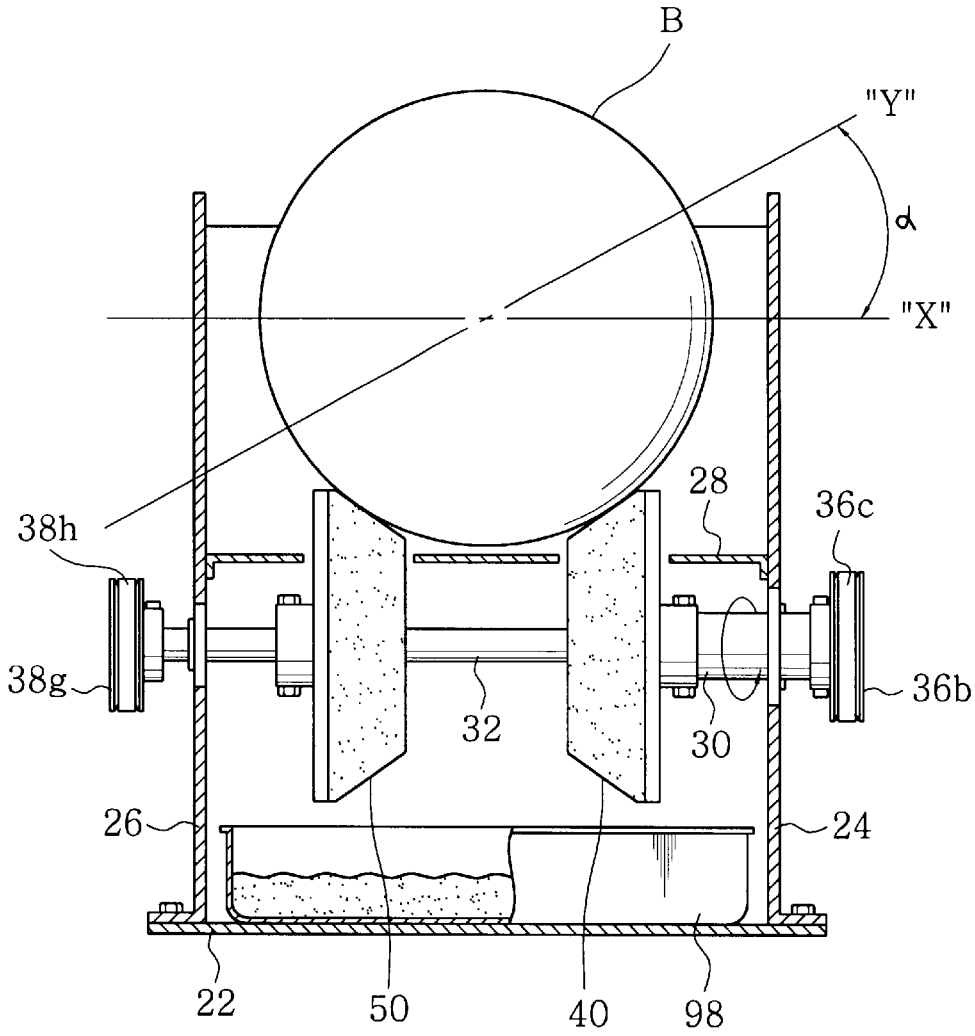

Specifically, as shown in FIGS. 4*a* and 4*b*, if the power of the first driving motor 34 transmitted to the second rolling wheel 50 is abruptly disconnected in a state where the bowling ball B is caused to rotate about an X-axis since the first and second rolling wheels 40, 50 are rotated at the same direction and speed as each other, the rotational speed of the second rolling wheel 50 is rapidly decreased and the axis of rotation of the bowling ball B is consequently changed from the X-axis to a Y-axis. Then, if the power of the first driving motor 34 is again transmitted to the second rolling wheel 50 after a predetermined period of time, the second rolling wheel 50 is again rotated at the same speed as the first rolling wheel 40 and the axis of rotation of the bowling ball B is consequently changed from the Y-axis to the X-axis. More specifically, if the rotation of the second rolling wheel 50 is abruptly restricted while the bowling ball B is caused to rotate by allowing the first and second rolling wheels 40, 50 to rotate simultaneously, the bowling ball B is rotated in such a manner that a linear speed of the portion of the bowling ball B, which is supported by the first rolling wheel 40, is relatively greater than that of the opposite portion of the bowling ball B, which is supported by the rolling wheel 50. Thus, the axis of rotation of the bowling ball B is changed from the X-axis to the Y-axis. Furthermore, if the rotational speed of the second rolling wheel 50 is again increased and is equal to that of the first rolling wheel 40, the bowling ball B is rotated in such a manner that the both portions of the bottom surface thereof have the same linear speed as each other. Thus, the axis of rotation of the bowling ball B is again changed from the Y-axis to the X-axis. Consequently, the axis of rotation of the bowling ball B is changed from the X-axis to the Y-axis and again from the Y-axis to the X-axis. Since such a process is repeatedly made, the rotational direction of the bowling ball B is changed at a variety of angles.

In addition, an angle range a of the axis of rotation of the bowling ball B can vary according to a period of time during which the clutch-brake unit 60 is operated, that is, an interval during which the power transmitted to the second rolling wheel 50 is disconnected. In other words, if the power transmitted to the second rolling wheel 50 is interrupted for a long time, the angle between the axes of rotation X and Y is increased since a rotation time of the second rolling wheel 50 with respect to the first rolling wheel 40 is relatively prolonged. On the other hand, if the power transmitted to the second rolling wheel 50 is interrupted for a relatively short time, the angle between the axes of rotation X and Y is decreased since the rotation time of the second rolling wheel 50 with respect to the first rolling wheel 40 is relatively shortened. Preferably, the angle range $\alpha$ of the axis of rotation of the bowling ball B is reduced by shortening the interval, as great as possible, during which the power transmitted to the second rolling wheel 50 is disconnected, and thus, an entire surface of the bowling ball B can be more evenly resurfaced. In the meantime, the operation time of the clutch-brake unit 60 is controlled through the push button 16 and the control board 19 disposed at the housing 10.

Referring again to FIG. 1, the resurfacing device of the present invention includes a friction contact unit 70 which supports a lateral side of the bowling ball B and simultaneously comes into friction contact with the surface of the bowling ball B, and a second driving motor 80 for causing the friction contact unit 70 to rotate. The friction contact unit 70 supports the bowling ball B at three points thereof together with the first and second rolling wheels 40, 50 and simultaneously abrades the surface of the bowling ball B, and comprises an abrasive wheel 72 fixed to a shaft 80*a* of the second driving motor 80 and an abrasive element 74 attached to the abrasive wheel 72 for resurfacing the bowling ball B. The abrasive wheel 72 is fitted into and fixed to the shaft 80*a* of the second motor 80, and includes an elastic pad 73. The elastic pad 73 is to resiliently support the bowling ball B, and includes an abrasive face 73*a* capable of coming into close contact with an outer surface of the bowling ball B. This elastic pad 73 is made from any material that can be elastically deformed and come into close contact with the outer surface of the bowling ball B.

The abrasive element 74 is attached to the abrasive face 73*a* of the elastic pad 73, and is composed of an abrasive stone, an abrasive cloth, or the like. This abrasive element 74 performs a process of abrading the surface of the bowling ball B while coming into friction contact with the surface of the bowling ball B rotated by the first and second rolling wheels 40, 50. In particular, as described above, since the axis of rotation of the bowling ball B is changed at various angles and contact portions of the bowling ball B with the abrasive element 74 are changed variously, the entire surface of the bowling ball B can be evenly abraded. Here, the abrasive element 74 is attached to the abrasive face 73*a* through an attaching means such as a Velcro fastener so that it can be easily detached from the abrasive face 73*a* if necessary. The reason is that the abrasive element 74 can be exchanged after wear thereof and it can be exchanged for another abrasive element 74 having different roughness if necessary. Of course, the abrasive element 74 may be exchanged for a washing cloth or a polishing cloth.

Furthermore, the second driving motor 80 for causing the friction contact unit 70 to rotate is fixed to the vertical plates 24, 26 of the frame 20 through a supporting bracket 82 with the friction contact unit 70 supported thereon, and thus, performs a function of supporting the friction contact unit 70 while causing the friction contact unit 70 to rotate. This second driving motor 80 holds the friction contact unit 70 so that the friction contact unit is directed to the center of the bowling ball B. That is, the friction contact unit 70 is held such that its axis of rotation l is coincident with the center of the bowling ball B. The reason is that contact efficiency of the friction contact unit 70 with the bowling ball B can be improved to the utmost.

Referring again to FIG. 1, the resurfacing device of the present invention further includes an abrasion assisting fluid supply means for supplying an abrasion assisting fluid to the surface of the bowling ball B. The abrasion assisting fluid supply means comprises an abrasion assisting fluid reservoir 90 for storing the abrasion assisting fluid therein, a fluid pump 92 for pumping the abrasion assisting fluid within the reservoir 90, a feeding tube 94 for feeding the pumped abrasion assisting fluid to the bowling ball B, and an injection nozzle 96 for injecting the fed abrasion assisting fluid onto the surface of the bowling ball B. The supply of the abrasion assisting fluid to the surface of the bowling ball B allows abrasive efficiency to be enhanced. Here, it is possible to store a washing or polishing fluid in the abrasion assisting fluid reservoir 90 instead of the abrasion assisting fluid, and to supply the stored washing or polishing fluid onto the surface of the bowling ball B.

In addition, the resurfacing device of the present invention further includes an abrasion assisting fluid drain basin 98 for accommodating the abrasion assisting fluid therein. The abrasion assisting fluid drain basin 98 is disposed at the bottom of the driving chamber 12 and performs a function of collecting the abrasion assisting fluid which drops downwardly after the abrasion of the bowling ball B. The abrasion assisting fluid drain basin 98 can be taken out of the driving chamber 12 through an opening 10*a* formed at a lower portion of the housing 10 so that the collected abrasion assisting fluid can be discarded or removed.

Further, the resurfacing device of the present invention is provided with a splash guard 99 for preventing the abrasion assisting fluid supplied to the bowling ball B from being splashed and scattered toward the first driving motor 34, the clutch-brake unit 60 and the like within the driving chamber 12. The splash guard 99 is installed at a lower end of the supporting bracket 82 and inclined toward the abrasion assisting fluid drain basin 98 so that it can guide the scattered abrasion assisting fluid to the abrasion assisting fluid drain basin 98.

Furthermore, the resurfacing device of the present invention includes an ejector mechanism 100 for ejecting the completely abraded bowling ball B from the first and second rolling wheels 40, 50. The ejector mechanism 100 comprises an ejector arm 102 which is installed on the vertical plates 24, 26 of the frame 20 so that it can be pivoted on a pivot shaft 102*a*, a pivotable push roller 104 which is installed on the ejector arm 102 so that it can come into contact with the bottom surface of the bowling ball B, and an actuator 106 which causes the ejector arm 102 to rotate so that the push roller 104 can push the bowling ball B. In particular, the actuator 106 is a solenoid, and is connected to the pivot shaft 102*a* of the ejector arm 102 through first and second links 107, 108 and is actuated by power applied thereto so as to rotate the pivot shaft 102*a* of the ejector arm 102.

The ejector mechanism 100 constructed as such can eject the bowling ball B from the first and second rolling wheels 40, 50 in such a manner that the actuator 106 allows the pivot shaft 102*a* to rotate, then the pivot shaft 102*a* allows the ejector arm 102 to be pivoted, and finally the push roller 104 pushes the bottom surface of the bowling ball B. Moreover, the horizontal portion 28*a* of the partition 28 is formed with a protruding guide rail 28*c* for receiving and guiding the ejected bowling ball B.

Next, the operation of the resurfacing device according to the present invention will be explained with reference to FIGS. 1 to 4*a* and 4*b*. First, the bowling ball B to be abraded is placed onto the first and second rolling wheels 40, 50, and the one side of the bowling ball is then held against the friction contact unit 70. Thereafter, a start button is pressed. Then, as shown in FIG. 3, the first driving motor 34 starts to operate, and the driving force of the first driving motor 34 is transmitted to the first and second driving shafts 30, 32 through the first and second power transmitting mechanisms 36, 38, respectively so that the first and second driving shafts 30, 32 can be rotated. If the first and second rolling wheels 40, 50 are rotated simultaneously in such a state, the bowling ball B supported by the two rolling wheels is also rotated about the X-axis of rotation, as shown in FIG. 4*a*.

In the meantime, if the start button is pressed, the second driving motor 80 shown in FIG. 1 is also operated. Then, the friction contact unit 70, and specifically, the abrasive element 74 is also rotated simultaneously, and consequently causes the surface of the bowling ball B to be abraded. Of course, since the bowling ball B is also rotated about the X-axis of rotation by means of the first and second rolling wheels 40, 50, the abrasive efficiency thereof is further improved. Moreover, the abrasion assisting fluid is continuously supplied to the surface of the bowling ball B through the injection nozzle 96 of the abrasion assisting fluid supply means while the abrasive element 74 comes into contact with the bowling ball B.

Further, while the friction contact unit 70 resurfaces the bowling ball B, the clutch-brake unit 60 intermittently interrupts the driving force of the first driving motor 34 transmitted to the second rolling wheel 50. Thus, the axis of rotation of the bowling ball B is changed from the X-axis to the Y-axis and again from the Y-axis to the X-axis, as shown in FIGS. 4*a* and 4*b*. Consequently, since the contact portions of the bowling ball with the friction contact unit 70 are also changed variously, the entire surface of the bowling ball is evenly abraded.

Then, if the process of abrading the bowling ball B has been completed, the actuator 106 of the ejector mechanism 100 is finally operated and causes the ejector arm 102 to rotate. Then, the push roller 104 attached to the ejector arm 102 is also pivoted simultaneously and pushes the bottom surface of the bowling ball B. Thus, the pushed bowling ball B is ejected from the first and second rolling wheels 40, 50 to the guide rail 28*c* of the partition 28.

Furthermore, the bowling ball resurfacing device of the present invention may have a function of a vending machine if a bill/coin validator is further provided within the bowling ball resurfacing device.

As described above, according to the bowling ball resurfacing device of the present invention, there is an advantage in that the entire surface of the bowling ball can be abraded, machined and furbished uniformly and automatically without leaving any uneven wear thereon since the surface can be processed while the axis of rotation of the bowling ball is changed variously. In particular, the bowling ball may be processed into the perfect sphere when manufactured. Further, since a one-way low capacity driving motor is merely utilized contrary to the prior art, noise generated therefrom can be reduced and durability thereof can be improved. Furthermore, since the structure of the bowling ball resurfacing device of the present invention is simplified, it is easy to manufacture the resurfacing device and production costs thereof are reduced.

The above-mentioned embodiment is merely a preferred embodiment of the present invention, and is not to be construed as limiting the scope of the present invention. Various modifications and changes can be made thereto within the spirit of the present invention. Therefore, the scope of the present invention should be defined by the appended claims and equivalents thereof.

What is claimed is:

1. A ball surface treatment device for treating, a surface of a ball, said device comprising:

first and second rolling wheels spaced from each other to form a cradle for holding and supporting the ball, said first and second rolling wheels being rotatable independently of each other;

a driving unit operatively connected to the first and second rolling wheels for causing the first and second rolling wheels to rotate;

a surface treatment unit for treating, the surface of the ball; and a relative speed regulator for intermittently changing, a rotational speed of one of the first and second rolling wheels with respect to the other wheel, so as to alter an axis of rotation about which the ball is caused to rotate.

2. The device as recited in claim 1, wherein the driving unit includes a first driving motor, and first and second power transmitting mechanisms for coupling the first driving motor with the first and second rolling wheels to allow power of the first driving motor to be transmitted to the first and second rolling wheels, respectively.

3. The device as recited in claim 2, wherein the relative speed regulator is a clutch-brake unit for intermittently interrupting the power of the driving unit transmitted to one of the first and second rolling wheels.

4. The device as recited in claim 2, further comprising an ejector mechanism for ejecting the ball out of contact with the surface treatment unit, wherein the ejector mechanism includes an ejector arm pivotable about a pivot shaft, a push roller carried at an end of the ejector arm, and an actuator for causing pivotal movement of the ejector arm about said shaft so that the push roller can push the ball out of contact with the surface treatment unit.

5. The device as recited in claim 1, wherein the relative speed regulator is a clutch-brake unit for intermittently the power of the driving unit transmitted to one of the first and second rolling wheels.

6. The device as recited in claim 1, wherein the surface treatment unit includes an abrasive wheel which has an abrasive face, a second driving motor for causing, rotation of the abrasive wheel with respect to the ball, and an abrasive element detachably mounted to the abrasive face of the abrasive wheel for abrading the surface of the ball.

7. The device as recited in claim 6, further comprising an abrasion assisting fluid supply for supplying an abrasion assisting fluid to the surface of the ball.

8. The device as recited in claim 1, further comprising an abrasion assisting fluid supply for supplying an abrasion assisting fluid to the surface of the ball.

9. The device as recited in claim 8, further comprising an abrasion assisting fluid drain for collecting the abrasion assisting fluid dropped from the ball.

10. The device as recited in claim 1, further comprising an ejector mechanism for ejecting the ball out of contact with the surface treatment unit, wherein the ejector mechanism includes an ejector arm pivotable about a pivot shaft, a push roller carried at an end of the ejector arm, and an actuator for causing pivotal movement of the ejector arm about said shaft so that the push roller can push the ball out of contact with the surface treatment unit.

11. The device of claim 1, wherein the first and second wheels have first and second rotational shafts, respectively, said shafts being coupled to and driven by the driving unit; and said shafts are not rigidly connected to each other.

12. The device of claim 1, wherein the first and second wheels have first and second rotational shafts, respectively, said shafts being coupled to and driven by the driving unit; and one of the shafts is rotatably received in a bore of the other shaft.

13. A bowling ball resurfacing device for abrading, polishing and washing a surface of a bowling ball, said device comprising:

a housing;

first and second rolling wheels rotatable provided within the housing in a spaced-apart relationship with each other to hold and support the bottom surface of the bowling ball;

driving means operatively connected to the first and second rolling wheels for causing the first and second rolling wheels to rotate;

a friction contact unit provided within the housing for supporting the bowling ball in cooperation with the first and second rolling wheels, and for making frictional contact with the surface of the bowling ball to abrade the bowling ball; and a relative speed regulator for intermittently changing a rotational speed of one of the first and second rolling wheels with respect to the other so as to alter an axis of rotation about which the bowling ball is caused to rotate wherein the relative speed regulator is a clutch-brake unit for intermittently interrupting the power of the driving means transmitted to one of the first and second rolling wheels.

14. The bowling ball resurfacing device as recited in claim 13, wherein the driving means include a first driving motor, and first and second power transmitting mechanisms for coupling the first driving, motor with the first and second rolling wheels to allow power of the first driving motor to be transmitted to the first and second rolling wheels, respectively.

15. A bowling ball resurfacing device for abrading, polishing and washing a surface of a bowling ball, said device comprising:

a housing;

first and second rolling wheels rotatable provided within the housing in a spaced-apart relationship with each other to hold and support the bottom surface of the bowling ball;

diving means operatively connected to the first and second rolling wheels for causing the first and second rolling wheels to rotate;

a friction contact unit provided within the housing for supporting the bowling ball in cooperation with the first and second rolling wheels, and for making frictional contact with the surface of the bowling ball to abrade the bowling ball; and a relative speed regulator for intermittently changing a rotational speed of one of the first and second rolling wheels with respect to the other so as to alter an axis of rotation about which the bowling ball is caused to rotate wherein the friction contact unit includes an abrasive wheel which has an abrasive face, a second driving motor for causing rotation of the abrasive wheel with respect to the bowling ball, and an abrasive element detachably mounted to the abrasive face of the abrasive wheel for abrading the surface of the bowling ball.

16. The bowling ball resurfacing device as recited in claim 15, further comprising abrasion assisting fluid supply means for supplying an abrasion assisting fluid to the surface of the bowling ball.

17. A bowling ball resurfacing device for abrading, polishing and washing a surface of a bowling ball, said device comprising:

a housing;

first and second rolling wheels rotatably provided within the housing in a spaced-apart relationship with each other to hold and support the bottom surface of the bowling ball;

driving means operatively connected to the first and second rolling wheels for causing the first and second rolling wheels to rotate;

a friction contact unit provided within the housing, for supporting the bowling ball in cooperation with the first and second rolling wheels, and for making frictional contact with the surface of the bowling ball to abrade the bowling ball;

a relative speed regulator for intermittently changing a rotational speed of one of the first and second rolling wheels with respect to the other so as to alter an axis of rotation about which the bowling ball is caused to rotate; and abrasion assisting fluid supply means for supplying an abrasion assisting fluid to the surface of the bowling ball.

18. The bowling ball resurfacing device as recited in claim 16, further comprising abrasion assisting fluid drain basin for collecting the abrasion assisting fluid dropped from the bowling ball.

19. A bowling ball resurfacing device for abrading, polishing and washing a surface of a bowling ball, said device comprising:

a housing;

first and second rolling wheels rotatably provided within the housing, in a spaced-apart relationship with each other to hold and support the bottom surface of the bowling ball;

driving means operatively connected to the first and second rolling wheels for causing the first and second rolling wheels to rotate;

a friction contact unit provided within the housing for supporting the bowling ball in cooperation with the first and second rolling wheels, and for making, frictional contact with the surface of the bowling ball to abrade the bowling ball;

a relative speed regulator for intermittently changing a rotational speed of one of the first and second rolling wheels with respect to the other so as to alter an axis of rotation about which the bowling ball is caused to rotate; and an ejector mechanism for ejecting the bowling ball out of contact with the friction contact unit, wherein the ejector mechanism includes an ejector arm provided within the housing for pivotal movement about a pivot shaft, a push roller carried at an end of the ejector arm, and an actuator for causing the pivotal movement of the ejector arm so that the push roller can push the bowling ball out of contact with the friction contact unit.

20. The bowling ball resurfacing device as recited in claim 19, wherein the driving means includes a first driving motor, and first and second power transmitting mechanisms for coupling the first driving motor with the first and second rolling wheels to allow power of the first driving motor to be transmitted to the first and second rolling wheels, respectively.

* * * * *